US007662332B2

(12) United States Patent
Chu et al.

(10) Patent No.: US 7,662,332 B2
(45) Date of Patent: Feb. 16, 2010

(54) ELECTRO-BLOWING TECHNOLOGY FOR FABRICATION OF FIBROUS ARTICLES AND ITS APPLICATIONS OF HYALURONAN

(75) Inventors: Benjamin Chu, Setauket, NY (US); Benjamin S. Hsiao, Setauket, NY (US); Dufei Fang, Setauket, NY (US); Akio Okamoto, Kanagawa (JP)

(73) Assignee: The Research Foundation of State University of New York, Albany, NY (US)

( * ) Notice: Subject to any disclaimer, the term of this patent is extended or adjusted under 35 U.S.C. 154(b) by 0 days.

(21) Appl. No.: 10/674,464

(22) Filed: Oct. 1, 2003

(65) Prior Publication Data

US 2005/0073075 A1 Apr. 7, 2005

(51) Int. Cl.
*D01D 5/08* (2006.01)
*D01D 5/098* (2006.01)
*H05B 7/00* (2006.01)

(52) U.S. Cl. ..... 264/465; 264/85; 264/555

(58) Field of Classification Search ..... 264/10, 264/85, 465, 518, 555
See application file for complete search history.

(56) References Cited

U.S. PATENT DOCUMENTS 3,338,992 A * 8/1967 Kinney ..... 264/465 X
4,904,174 A * 2/1990 Moosmayer et al. .. 425/174.8 E
5,633,001 A 5/1997 Agerup
6,685,956 B2 2/2004 Chu et al.
6,689,374 B2 2/2004 Chu et al.
6,695,992 B2 * 2/2004 Reneker ..... 264/555 X
6,713,011 B2 3/2004 Chu et al.
7,172,765 B2 2/2007 Chu et al.
2003/1016875 9/2003 Balkus, Jr. et al.
2004/0146546 A1 * 7/2004 Gravett et al. ..... 424/445
2005/0067732 A1 * 3/2005 Kim et al. ..... 264/172.19

OTHER PUBLICATIONS

PCT International Preliminary Report on Patentability, mailed Apr. 13, 2006.

* cited by examiner

*Primary Examiner*—Leo B Tentoni
(74) *Attorney, Agent, or Firm*—Oblon, Spivak, McClelland, Maier & Neustadt, L.L.P.

(57) ABSTRACT

A method for electroblowing fibers is provided which involves the steps of:

forcing a polymer fluid through a spinneret in a first direction towards a collector located a first distance from the spinneret, while simultaneously blowing a gas through an orifice that is substantially concentrically arranged around the spinneret, wherein the gas is blown substantially in the first direction;

wherein an electrostatic differential is generated between the spinneret and the collector; and collecting the fibers, and its use in preparing submicron scale fibers of various types, particularly hyaluronan fibers, and the hyaluronan nanofibers thus formed.

33 Claims, 17 Drawing Sheets

ELECTRO-BLOWING TECHNOLOGY FOR FABRICATION OF FIBROUS ARTICLES AND ITS APPLICATIONS OF HYALURONAN

BACKGROUND OF THE INVENTION

1. Field of Invention

The present invention relates to a method for spinning nanofibers that combines aspects of electrospinning and melt-blowing, its application to spinning of hyaluronan and the nanofibrous materials made thereby.

2. Discussion of the Background

One technique conventionally used to prepare fine polymer fibers is the method of electrospinning. When an external electrostatic field is applied to a conducting fluid (e.g., a charged semi-dilute polymer solution or a charged polymer melt), a suspended conical droplet is formed, whereby the surface tension of the droplet is in equilibrium with the electric field. Electrospinning occurs when the electrostatic field is strong enough to overcome the surface tension of the liquid. The liquid droplet then becomes unstable and a tiny jet is ejected from the surface of the droplet. As it reaches a grounded target, the jet stream can be collected as an interconnected web of fine sub-micron size fibers. The resulting films from these non-woven nanoscale fibers (nanofibers) have very large surface area to volume ratios.

The electrospinning technique was first developed by Zeleny[1] and patented by Formhals[2], among others. Much research has been done on how the jet is formed as a function of electrostatic field strength, fluid viscosity, and molecular weight of polymers in solution. In particular, the work of Taylor and others on electrically driven jets has laid the groundwork for electrospinning[3]. Although potential applications of this technology have been widely mentioned, which include biological membranes (substrates for immobilized enzymes and catalyst systems), wound dressing materials, artificial blood vessels, aerosol filters, and clothing membranes for protection against environmental elements and battlefield threats[4-26].

The major technical barrier for manufacturing electrospun fabrics is the speed of fabrication. In other words, as the fiber size becomes very small, the yield of the electrospinning process becomes very low. For example, if one considers a polymer melt being spun from the spinneret with a diameter of 700 μm, and the final filament is formed with a diameter of 250 nm, the draw ratio will then be about $3\times10^6$. As the typical throughput of the extrudate from a single spinneret is about 16 mg/min (or 1 g/hr), the final filament speed will be about 136 m/s, as compared to the highest speed (10,000 m/min or 167 m/s) attainable by the high-speed melt-spinning process. Thus, the throughput of the spinneret in conventional electrospinning is about 1000 times lower than that in the commercial high-speed melt-spinning process.

Another major technical problem for mass production of electrospun fabrics is the assembly of spinnerets during electrospinning. A straightforward multi-jet arrangement as in high-speed melt spinning cannot be used because adjacent electrical fields often interfere with one another, making the mass production scheme by this approach impractical.

A unique esJets™ technology for multiple-jet electrospinning process has recently been developed for manufacturing of non-woven membranes having fibers with diameters in the tens of nanometers size range. Three patent applications based upon this technology have been filed[27-29] and several papers have also been published[30-34].

Hyaluronan (HA) is an associated polymer, having the following structure:

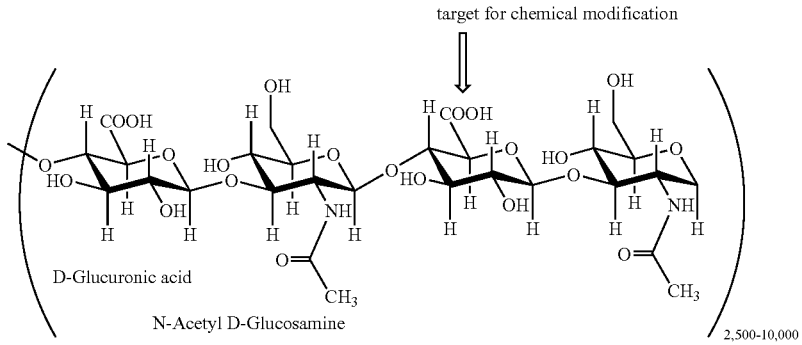

HA has an acidic group as well as a glucosamine segment. The presence of this weak acid makes the polymer a polyelectrolyte, i.e., its charge density depends on the degree of dissociation, that can be influenced by factors including, but not limited to:

pH ionic strength nature of co-ions and counter ions solvent quality that shall also affect the above 3 conditions.

The degree of association can be disturbed by physical and/or chemical means. For example:

By physical means, e.g., ultra-sonics, shear, microwave, etc.

By chemical means, such as complex formation with a liquid, e.g., polyethylene oxide is soluble in water because of its hydrogen bonding with water.

SUMMARY OF THE INVENTION

Accordingly, one object of the present invention is to provide a method for processing of polymer solutions that combines the benefits of electrospinning and melt-blowing while broadening the conditions that either method alone can operate.

A further object of the present invention is to provide a method for the processing of hyaluronan solutions that allows for higher throughput production of nanofibrous hyaluronan.

A further object of the present invention is to provide nanofibrous membranes of hyaluronan.

A further object of the present invention is to provide a method for processing polymer solutions that increases the operational range normally accessible by electrospinning alone and substantially increases the production rate.

These and other objects of the present invention have been satisfied by the discovery of a method for electroblowing fibers comprising:

forcing a polymer fluid through a spinneret in a first direction towards a collector located a first distance from said spinneret, while simultaneously blowing a gas through an orifice that is substantially concentrically arranged around said spinneret, wherein said gas is blown substantially in said first direction;

wherein an electrostatic differential is generated between said spinneret and said collector; and collecting the fibers;

and the ability to use this process not only on a wide variety of polymers, but most preferably on the electroblowing of hyaluronan nanofibers, and the hyaluronan nanofibers produced thereby.

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
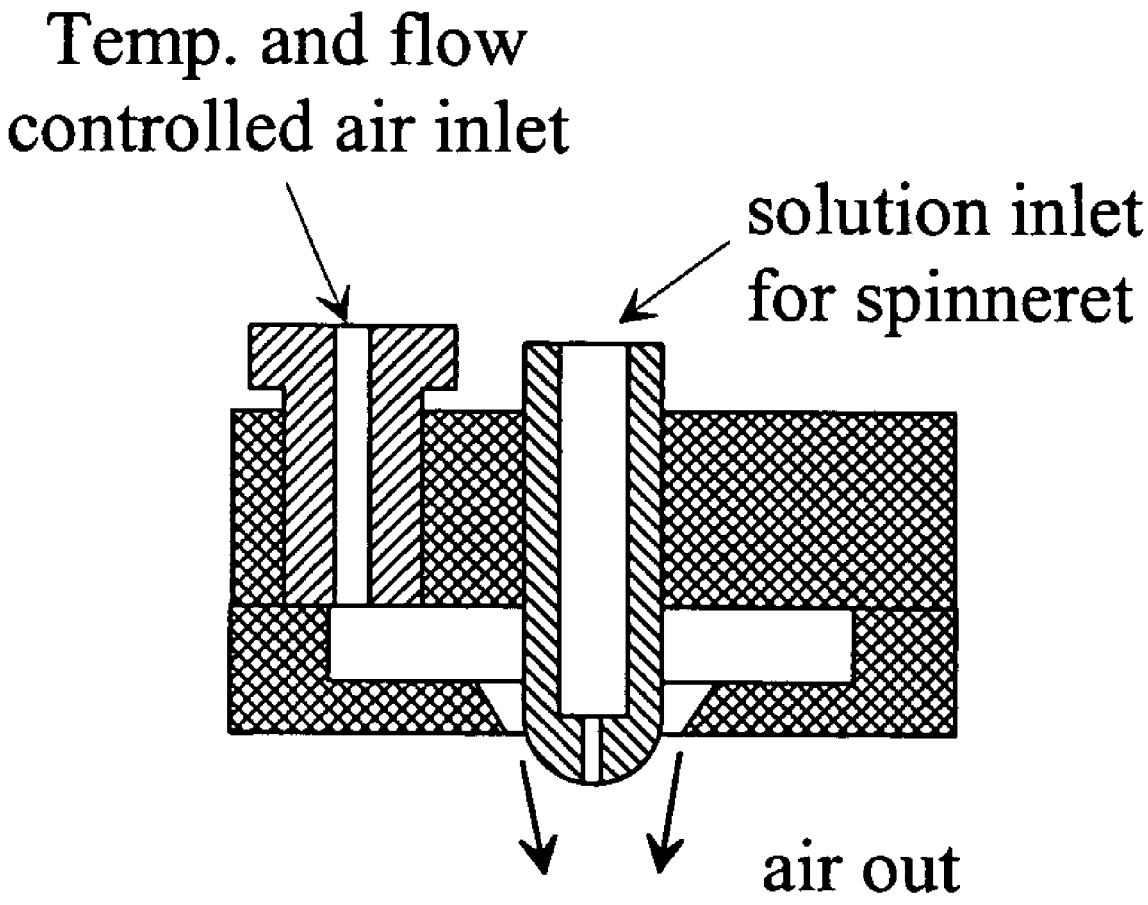
FIG. 1 is a schematic of an embodiment of electro-blowing spinneret design used in the present method.

The present invention provides a new method for the formation of nanoscale fibers and non-woven membranes which permits the spinning of polymer solutions that either cannot be conventionally used in electrospinning or that cannot be spun with high throughput using conventional electrospinning. The present method is preferably useful for the spinning of nanoscale fibers of hyaluronan (HA). Since the present method combines aspects of electrospinning and melt blowing, the present inventors have dubbed the new method "electro-blowing". This term will be used herein to refer to the new process. Much of the following description refers specifically to the electro-blowing of HA solutions. However, the same considerations and method can be applied to any polymeric solution or polymer melt, provided that the polymer solution or melt is susceptible to electrospinning (i.e. contains sufficient charge density to be affected by application of electrostatic potentials) or can be modified to be susceptible to electrospinning.

As noted above, in an electro-spinning process, the pulling force primarily depends on the applied electrostatic field. The charged liquid droplet at the spinneret is being pulled out when the electrostatic field at the tip of the spinneret is strong enough to overcome the surface tension holding the charged liquid droplet.

In the present electro-blowing process, this requirement has been relaxed by combining the electrostatic field with a gaseous flow field. Like melt blowing where the liquid droplet (no charge required) is pulled out by the gaseous flow, the present method processing technique requires that only the combined forces are strong enough to overcome the surface tension of the charged liquid droplet. This permits the use of electrostatic fields and gas flow rates that are significantly reduced compared to either method alone.

This combination reduces the demanding requirements of both the electrostatic field and the very fast gaseous flow rate that would be needed without the mutual benefits. It should also be noted that the fluid used in the present process can be either a solution or a solid in the melt state (i.e., a liquid). For simplicity, the following description will be directed toward the use of polymer solutions. The description is equally applicable to polymer melts, with polymer melts being basically a polymer solution at 100% concentration. Furthermore, the solution or the melt can be a multi-component system, thus allowing for the combined electro-blowing of combinations of two or more polymers at once.

Both the gaseous flow stream and the electrostatic field are designed to draw the fluid jet stream very fast to the ground. The spin-draw ratio depends on many variables, such as the charge density of the fluid, the fluid viscosity, the gaseous flow rate and the electrostatic potentials, where a secondary electrode can also be implemented to manipulate the flow of the fluid jet stream. It is noted that these variables can be altered in mid-stream during processing. For example, injection of electrostatic charges can be used to increase the charge density of the fluid (either solution or melt) or even convert a neutral fluid to a charged fluid. The temperature of the gaseous flow can change the viscosity of the fluid. The draw forces increase with increasing gaseous flow rate and applied electrostatic potentials.

The intimate contact between the gas and the charged fluid jet stream provides more effective heat transfer than that of an electro-spinning process where the jet stream merely passes through the air surrounding the jet stream. Thus, the gas temperature, the gas flow rate, and the gaseous streaming profile can affect and control the evaporation rate of the solvent, if the fluid is a solution, or/and the cooling rate of the liquid in the melt state. In the latter case, this control can be related to the rapid quenching processes in phase transitions, including control of fractions of the amorphous phase, the mesophase, and the crystalline phase in semi-crystalline polymers. It should be noted that there is friction at the fluid-gas interface. The gas temperature can vary from liquid nitrogen temperature to super-heated gas at many hundreds of degrees; the preferred range depends on the desired evaporation rate for the solvent and consequently on the solvent boiling temperature. In the case of a polymer melt, the gas flow rate can go up to the velocity of sound, as in melt blowing. The preferred rate depends on the viscosity and the desired spin draw ratio. The streaming profiles are aimed at stabilizing the jet streams and should be similar to those used in melt blowing.

At the interface between the gaseous stream and the fluid jet stream, shearing of the fluid surface occurs. The shear force affects the interior of the fluid jet stream because the fluid, which is either a polymer solution above its overlap concentration or a polymer melt, is a viscoelastic fluid. Thus, the inward propagation of the shearing effect takes time and depends on the magnitude of the shear force. In contrast to the shear force produced by the gaseous flow, the stretching of the fluid jet stream by the applied electric field comes from charge flow, as illustrated in the electro-spinning process, and it does not have the skin-core effect. The combination of gas flow and electrostatic potential can also change the shearing effect at the fluid-gas interface.

Finally, the blowing aspect of the present invention also provides an effective means to transfer heat and solvent, if the fluid is a solution, away from the processing zone.

The combination of electrostatic forces and gaseous blowing in the present method has the following key advantages:

1. The type of fluids that can be electro-spun or melt-blown are expanded. The requirements in the fluid limit for viscosity, surface tension, polymer concentration, molecular weight and its distribution can be relaxed.
2. The additional variables in gaseous flow rate and temperature as well as the nature of the gas (not necessarily limited to air) can be used to control the solvent evaporation rate, the heat (and materials) transfer between the fluid jet stream and the gaseous stream.
3. The production rate can be increased due to the expanded boundary conditions. For example, faster fluid flow rate can now be incorporated into the process that cannot be otherwise achieved in an electro-spinning process. In electro-spinning, a faster than acceptable fluid flow rate will produce large droplets, falling to the ground due to gravity. With the gaseous blowing, the boundary conditions have all changed and a much faster fluid flow rate can be used for electro-blowing.
4. The balance between the two driving forces (electrostatic field and gaseous flow field) can be expanded further by a substantial increase in the gaseous flow rate (by a factor of 10-20 of that used in the demonstration examples), with a practical limit of the velocity of sound, and the charge density of the fluid (by charge injection).

For electro-blowing of polymer melts or solutions, it is necessary to have the polymer solution fall within a certain range of viscosity, surface tension, polymer molecular weight and concentration (for solutions). These factors are predominantly controlled by having the present invention be performed over a range of experimental conditions as follows:

1. HA (with a molecular weight of about 3 million) concentration—0.5 to 8, preferably 1 to 5, more preferably 2.0 to 3.0% (wt %)
2. Feeding rate of HA solution—5 to 150, preferably 10 to 80, more preferably 30 to 50 (μl/min)
3. Air blow temperature—0 to 200, preferably 25 to 120, more preferably 40 to 90(° C.)
4. Air blow rate—0 to 300, preferably 10 to 250, more preferably 30 to 150(SCFH)
5. Electric field—1 to 55, preferably 15 to 50, more preferably 30 to 45 (kVolt).

The following considerations are also important in the electro-blowing process:

Minimization of the association behavior since, at the spinneret, the associated polymer molecules can undergo partial dissociation. Polymer association can significantly increase the apparent molecular size. As a result, the corresponding viscosity increases substantially. The most suitable measurement to quantify the association behavior is by rheology.

The polymer solution should have a high-enough concentration so that the solvent has essentially been removed (or evaporated) when the jet stream touches the collection plate (ground). This requirement means that we need to have means (a) to optimize the MW and MWD needed to achieve the c/c*, with c* being the overlap concentration and c/c*, the reduced overlap concentration, value appropriate for this purpose, (b) to use a solvent mixture that can be evaporated more easily, and (c) to provide efficient means to remove the solvent mixture in the jet stream.

The conventional electro-spinning process requires careful consideration of a large number of processing variables (e.g., electric field strength, electrode configuration, spinneret diameter, flow rate of solution) and molecular parameters that control the physical properties of HA solution (e.g., solution viscosity and surface tension). Electro-spinning of HA solution is made even more difficult because of the following unusual physical properties of HA solution:

HA solution has an unusually high viscosity making it difficult to prepare highly concentrated solution HA solution shows a high surface tension.

Consequently, it becomes difficult to prepare a highly concentrated HA solution, especially when the HA molecular weight is sufficiently high. HA is believed to be a highly associated polyelectrolyte, resulting in an unusually high solution viscosity. Thus, the strategy for electro-spinning of HA solution would be to consider means that Can reduce the association and therefore the solution viscosity.

Can lower the surface tension.

Although a range of approaches have been used in an attempt to expand the experimental ranges for polymer fluids over which the electro-spinning process could be applied, the results overall were not successful.

In an effort to solve the viscosity/surface tension problem and for polymer solutions at relatively lower concentrations, the present method was developed by combining the pulling forces of a gaseous stream with the electrostatic potential. The gas blow system with controlled temperature can evaporate the solvent at a desired rate and stabilize the jet stream. Thus, the present invention of electro-blowing process has removed the restrictions on viscosity, surface tension, polymer concentration, nature of solvent, etc. that are present with the conventional electrospinning or melt-spinning processes. The rate of gaseous flow, the temperature of the gas, and the gas-flow profile now become the additional parameters that can control the nanofiber formation. It should be noted that the term 'gas' denotes suitable materials in the gaseous state, including but not limited to, air, nitrogen, reactive gases and inert gases, as well as mixtures thereof. Preferred gases are air and nitrogen.

For other polymers of different molecular weights, the concentration may be different. For example, the range for poly(acrylonitrile) (PAN) is preferably from 2 wt % to 14 wt % (saturated concentration) in DMF; for poly(urethane) it is preferably from 1 wt % to 15 wt %; poly(glycolide-co-lactide) is preferably from 10 wt % to 40 wt % in DMF. The range for other parameters such as electric field, feeding speed etc., are closely coupled with the concentration range. However, the overall range for the parameters is roughly the same as listed above.

The present invention can be applied not only to HA, but also to a range of other polymers. Any polymer that can form a melt or solution containing charge density or that can be modified to have sufficient charge density for electrospinning can be used in the present invention, preferably including, but not limited to, polyalkylene oxides, poly(meth)acrylates, polystyrene based polymers and copolymers, vinyl polymers and copolymers, fluoropolymers, polyesters, polyurethanes, polyalkylenes, polyamides, polyaramids and natural polymers. More preferred polymers include poly(ethylene oxide), polyacrylonitrile, poly(methyl methacrylate), poly(2-hydroxyethyl methacrylate), polystyrene, poly(ether imide), polycarbonate, poly(caprolactone), poly(vinyl chloride), poly(glycolide), poly(lactide), poly(p-dioxanone), poly(ethylene-co-vinyl alcohol), polyacrylic acid, poly(vinylacetate), poly (pyrene methanol), poly(vinyl phenol), polyvinyl pyrrolidone, poly(vinylidene fluoride), polyaniline, poly(3,4-polyethylenedioxythiothene), polypropylene, polyethylene, butyl rubber, polychloroprene, acrylonitrile-butadiene-styrene triblock copolymer, styrene-butadiene-styrene (SBS) triblock copolymer, poly(urethane), poly(urethane urea), poly(amic acid), polyesters (including, but not limited to, poly(ethylene terephthalate), poly(propylene terephthalate), poly(butylene terephthalate), poly(ethylene naphthalate), or poly(ethylene terephthalate-co-ethylene isophthalate)), polyamides (including, but not limited to, nylon 6; nylon 66, or nylon 46), polyaramid, poly(p-phenyleneterephthalamide), polybenzimidazole, poly(ferrocenyldimethylsilane), starch, cellulose acetate, collagen, fibrinogen, *Bombyx mori* and *Samia cynthia ricini* silk fibroins, elastin-mimetic peptide polymers, enzyme-lipase. These polymers can be used singly, or as their copolymers, polymer blends, and blends with nanofillers, including, but not limited to, carbon nanotubes (single-walled and multiple-walled), carbon nanofibers, layered silicates, or poly(oligomeric silsesquioxane).

In preparing solutions for use in the present process, any solvents can be used, so long as the solvent can be readily evaporated during the process. Preferred solvents include, but are not limited to: water, minimal essential medium (Earle's salts), chloroform, methylene chloride, acetone, 1,1,2-trichloroethane, dimethylformamide (DMF), tetrahydrofuran (THF), ethanol, 2-propanol, dimethylacetamide (DMAc), N-methylpyrrolidone, acetic acid, formic acid, hexafluoro-2-propanol (HFIP), hexafluoroacetone, 1-methyl-2-pyrrolidone, low molecular weight polyethylene glycol (PEG), low molecular weight paraffins, low molecular weight fluorine-containing hydrocarbons, low molecular weight fluorocarbons, and mixtures thereof.

Some important considerations in the electro-blowing of HA are as follows:

1. The blowing hot air has a decisive role in the electro-blowing process. It can expand the range of fluids that can be spun into nanofibrous non-woven membranes, including the fluid viscosity, surface tension, polymer molecular weight, and molecular weight distribution.
2. The high molecular weight of HA favors fiber formation and reduced bead formation.
3. The fabrication of HA solution depends on air temperature, blow rate, HA concentration, feeding rate of solution, and strength of electric field.
4. The size of electrospun HA fiber can be controlled by changing air temperature, blow rate, and HA concentration.
5. The electric field strength for electro-blowing of HA can be reduced from 40 kV to 25 kV with a distance between the electrodes of 9.5 cm, making possible the electro-blowing of HA solution with multi-jet operations for mass production.
6. Blends of different MW HA and addition of organic solvents can be used to improve the processing of HA.

Electro-Blowing Technology

To increase the production rate of each jet, the present invention provides a new electro-blowing technology. The air blow system contains two components: an air-blowing assembly and a heating assembly (FIG. 1). The gaseous flow rate can be controlled directly by a speed-controlled blower while the air temperature can be controlled by heating elements. In addition, the air temperatures at different locations of the air blow system, being dependent upon the air-flow rate, can be monitored to fine-tune the air temperature at the spinneret. The spinneret has situated around it an orifice through which the gas (air) is blown. The orifice is substantially concentrically arranged around the spinneret. Within the context of the present invention, the term "substantially concentrically arranged" indicates that there may be gaps in the orifice, but that the orifice surrounds the spinneret such that the gas being ejected from the orifice is not present on only one side of the fibers being generated. Preferably, the term indicates that the orifice is arranged to surround at least 75% of the spinneret, more preferably at least 90% of the spinneret.

In our study to electro-blow the viscous hyaluronan (HA) solutions of different compositions and molecular weight, the following operational conditions were tested. (We note that the HA solutions are typically too viscous to be electro-spun.) The effects of air blow temperature (39, 47, and 57° C.) at 70 $ft^3$/hr of air blow rate as well as of different air blow rates (35, 70, 100 $ft^3$/hr) were examined. The average air speed of the flowing gas (or air in the present case) near the spinneret was estimated from the volumetric flow rate and the cross-section of air outlet near the spinneret. For 60 $ft^3$/hr, the average air speed was about 12.5 m/sec, i.e., a factor of 20 lower than that commonly used in melt blowing. Clearly, the flow rate can be increased to increase the contribution to the pulling force. The experimental parameters can be further optimized in order to achieve an increase in the production rate per spinneret by about an order of magnitude and a robust operation that permits better cost-effective mass production.

Constant Pressure Linear Fluid Distribution System

Figure 2:
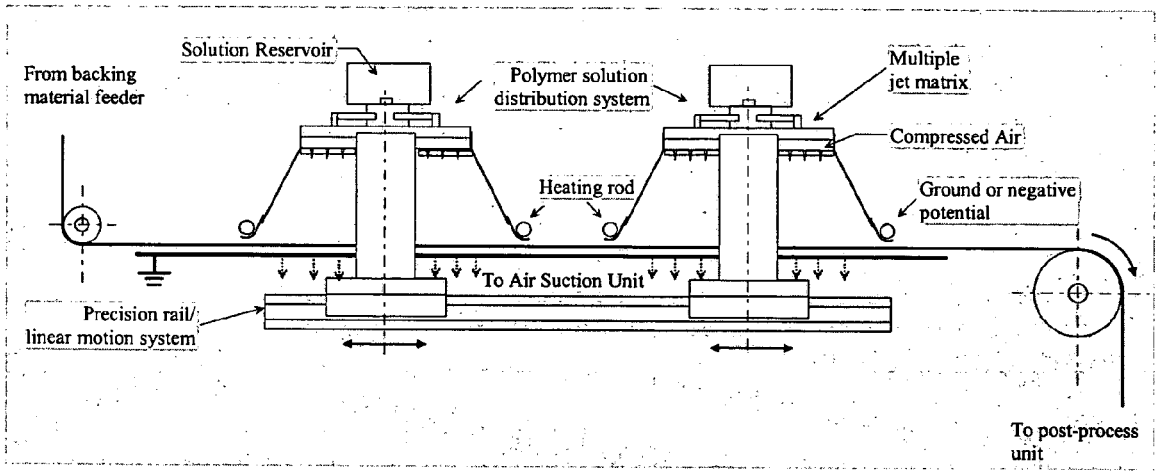
FIG. 2 is a schematic of an embodiment of an integrated fluid distribution/linear array jet assembly useful for scale-up operations in the present invention.

A simple, robust and easy to maintain linear fluid distribution system is also provided by the present invention. The schematic diagram of such a distribution system is shown in FIG. 2. In the constant pressure mode, the solution is pumped in periodically. The level indicator will control the amount of the solution in the container. The electronic gas pressure gauge/controller can be automatically adjusted, such that the air (or inert $N_2$) pressure inside the solution container can be maintained at a constant level using a feed back mechanism. The value of the "constant" pressure can be adjusted based on solution viscosity, spinneret exit hole size and flow rate requirements. One of the reasons for developing this distribution approach is to reduce the number of components for the fluid distribution system.

Construction of a Mass Production Facility

Figure 3:
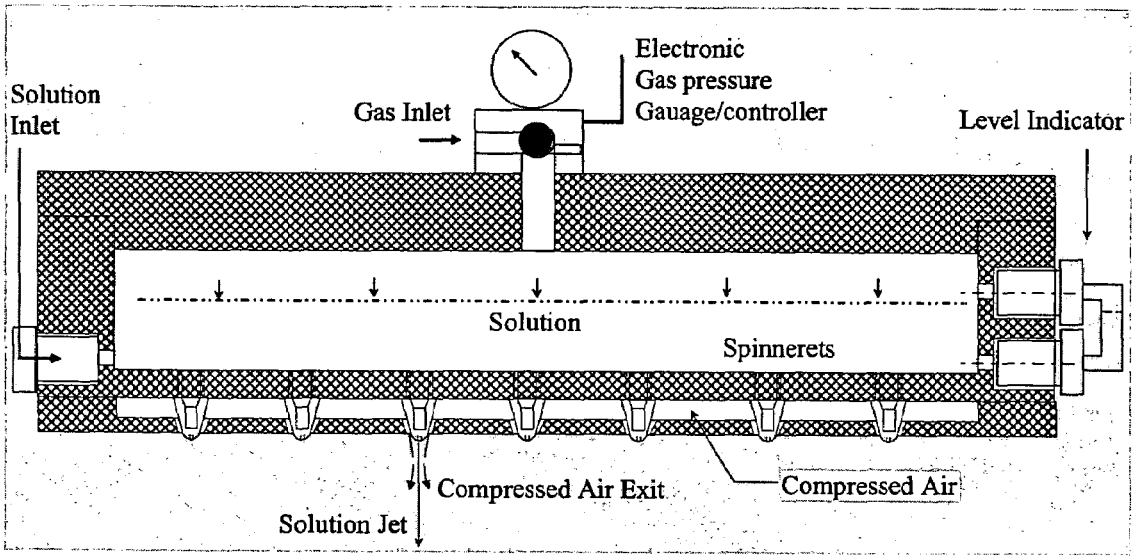
FIG. 3 is a schematic of an embodiment of a constant pressure linear solution distribution system useful in performing the present method.
Figure 4:
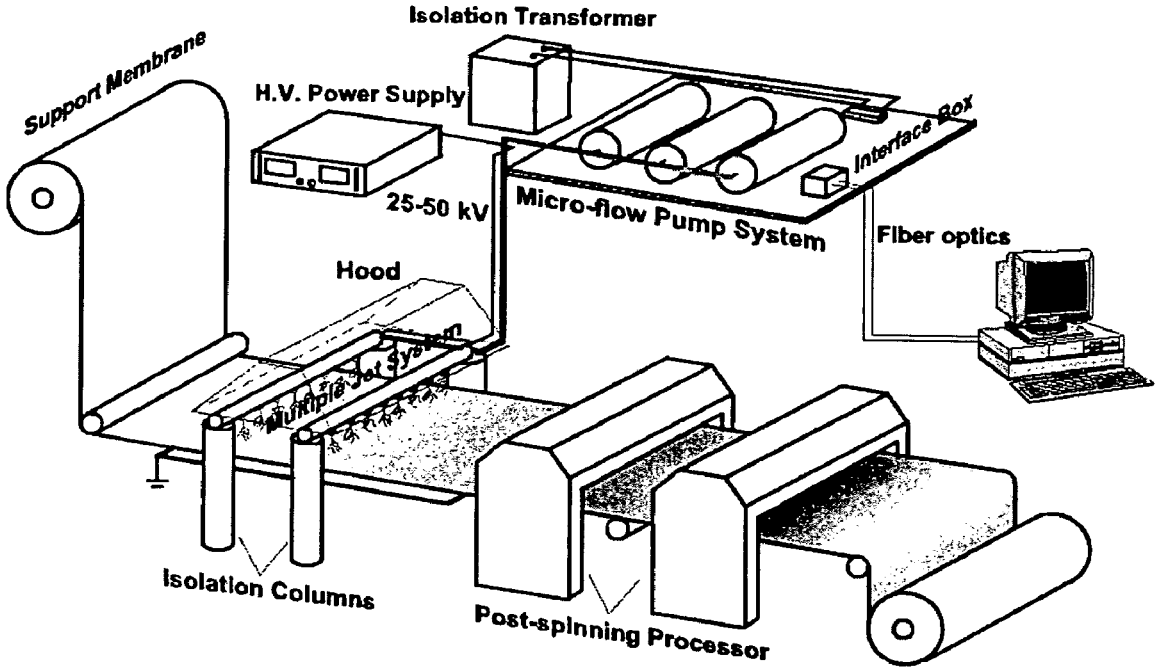
FIG. 4 is a schematic of a further embodiment of a scale-up multiple jet operation unit useful in performing the present invention.

Also provided by the present invention is a large multiple-jet electro-spinning facility. The production rate of this facility is about 450 times faster (5 times faster in each spinneret with the electro-blowing design, with 6 banks of 15 jets in linear array in a most preferred embodiment) than the typical production rate from the single-jet operation. The technology for this operation is again rested on the design of a robust, easy to maintain, and low cost large-scale fluid distribution system and an electrode clean-up procedure during the electro-spinning process for sustained operations. The multiple electrode assembly contains a plurality, preferably 10-20, more preferably 15, electrodes in each linear array while using the same pressure source and control system as illustrated in FIG. 2. Multiple arrays of spinnerets can be assembled in a modular format. The schematic diagram of an integrated fluid distribution and the linear array electrode assembly of such a design is shown in FIG. 3. A preferred embodiment of the system is schematically represented in FIG. 4. The backing material for the membrane can be fed into the system by a large dimension "conveyer belt". The polymer solution can be distributed to the multiple spinneret linear array system with a minimum pressure drop. The array system is mounted on two electrically isolated posts that are seated on a pair of precision rails. This allows the array system to move along the "belt" direction back and forth. The precision rails can also be mounted on a "rocking" system so that the array can move in the direction perpendicular to the "belt" direction to ensure the uniform thickness distribution of electro-spun membranes. The heating elements can be implemented to control the solvent evaporation rate and thus to increase the throughput rate. The "belt" can be sent to another unit or a post-processing unit for fabricating composite membranes. Several sets of such a system can also be arranged sequentially on the same conveyor belt in order to increase the production rate.

EXAMPLES

Having generally described this invention, a further understanding can be obtained by reference to certain specific examples which are provided herein for purposes of illustration only and are not intended to be limiting unless otherwise specified.

The following conditions were used for the electro-blowing of HA, unless otherwise specified.

1. HA concentration: 2.5% (w/v) HA-C in acidic aqueous solution (MW: 3.5 million)
2. Feeding rate: 40 μl/min
3. Electric field: 40 kV
4. Distance between electrodes: 9.5 cm.

TABLE 1

HA Sample Identifications

| HA sample | Preparation method | Molecular weight | Content of NaCl (wt %) | Viscosity (Pa · s at 1 $s^{-1}$) |
|---|---|---|---|---|
| HA-C | Supplied from Denka | 3,500,000 | 0 | 21 (0.7%) |
| HA-B | Supplied from Denka | 200,000 | 1.6 | 27 (10%) |
| HA-A | Supplied from Denka | 45,000 | 2.1 | 13 (25%) |
| HA-5 | Ultrasonicated for 5 min | Unknown | 0 | 16 (3%) |
| | Detailed preparation method is provided as shown below | | | 3.3 (2%) |
| HA-10 | Ultrasonicated for 10 min | Unknown | 0 | 2.0 (4%) |
| HA-15 | Ultrasonicated for 15 min | Unknown | 0 | 3.2 (6%) |

Preparation of HA Samples with Different Mw by Ultrasonication 1. 50 ml of 1.0% (w/v) aqueous HA-C solution was prepared.
2. The solution was ultrasonicated with 50% amplitude setting using the Ultrasonication-Homogenizer for different time periods (5, 10, and 15 min).
3. The ultrasonicated HA-C solution was poured into a petri dish to dry under a hood at room temperatures overnight.
4. The ultrasonicated HA solutions (HA-5, -10, -15) were prepared by dissolving the ultrasonicated HA in a solvent.

The air blow system used in this study has two components: an air-blowing assembly and a heating assembly. The gaseous flow rate is controlled directly by a speed-controlled blower while the air temperature is determined by the heating elements in the air blow system. In addition, the air temperatures at different locations of the air blow system, being dependent upon the airflow rate, are monitored to fine-tune the air temperature at the spinneret.

The temperatures of air blow were calibrated at three different locations over a range of heating power and airflow rate, as listed in Table 2.

TABLE 2

Temperatures (° C.) at different heater power and air flow rate

| Flow rate ($ft^3$/hour) | Heater power (V) 30 (A-B-C) | 40 | 50 | 60 |
|---|---|---|---|---|
| 35 | 45-n-n | 58-50-47 | 71-**61**-54 | |
| 70 | 41-**39**-38 | 51-**47**-45 | 63-**57**-53 | |
| 100 | 36-n-n | 45-43-41 | 57-**55**-52 | 71-n-n |
| 150 | | | 48-47-46 | 59-**56**-53 |

Figure 5:
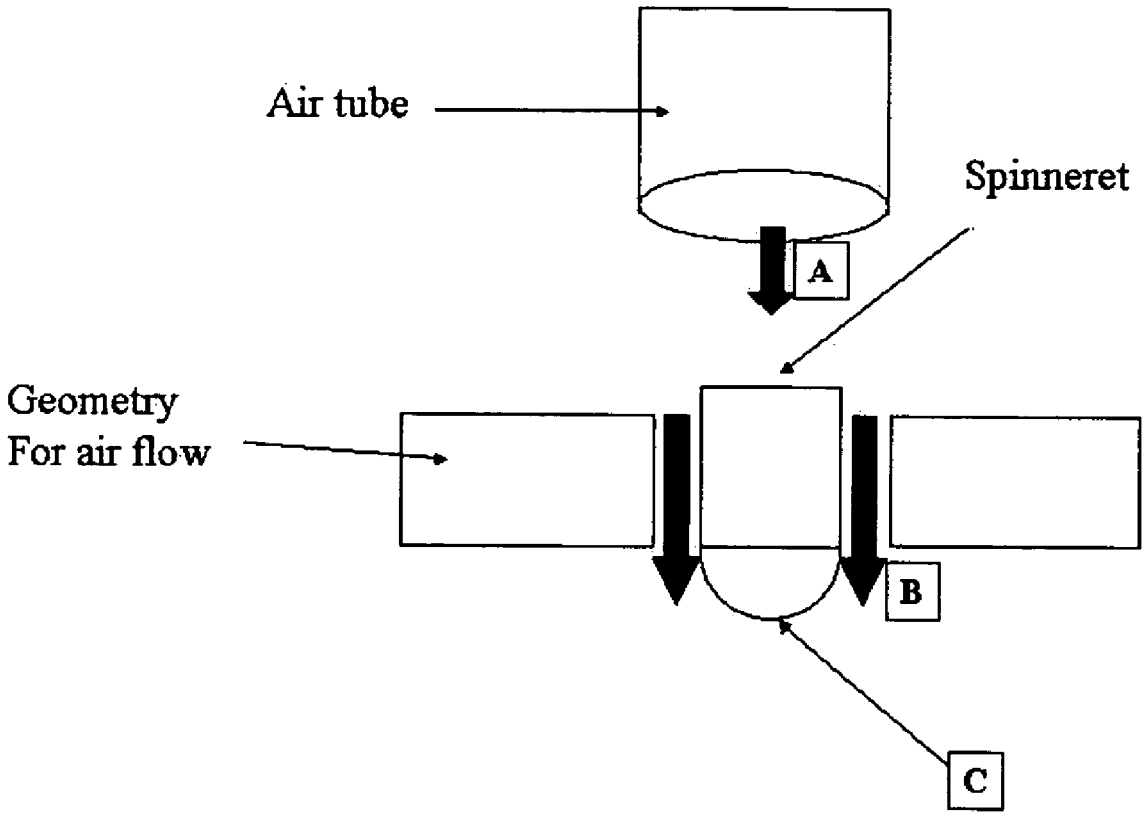
FIG. 5 is a schematic of a spinneret for electroblowing, showing the position of air temperature measurement locations used in the present examples.

As presented in FIG. 5, the temperatures were measured at three different locations: the outlet of air tube (A), around the spinneret (B), and the outlet of the spinneret where the solution comes out (C). Among the three spots, the temperature at spot C is almost the same as the solution temperature. Thus, the temperature at spot C (bold typed in Table 2) was used as the air blow temperature.

To investigate the effects of air blow temperature on the electro-blowing process, values of 39, 47, and 57° C. at 70 $ft^3$/hr of air blow rate were used. Furthermore, different air blow rates at 35, 70, 100 $ft^3$/hr at 50 V of heating power were used to examine the effects of air blow. In the case of 150 $ft^3$/hr, since the air blow temperature was relatively too low, 60 V of heating power were used, rather than 50 V, to adjust the temperature. The average air speed of the flowing gas (or air in the present case) near the spinneret is estimated from the volumetric flow rate and the cross-section of air outlet near the spinneret. For 60 $ft^3$/hr, the average air speed is about 12.5 m/sec, about a factor of 20 lower than that commonly used in melt blowing. Clearly, the flow rate can be increased to increase the contribution to the pulling force. However, the present work was more concerned with the balance between airflow and electric field.

Results and Discussion

Figure 6A:
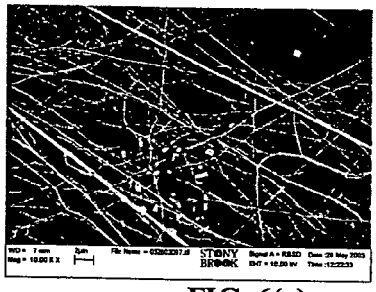
FIGS. 6(*a*)-(*c*) provide photographs of electroblown fibers showing the effect of air blow temperature on the morphology of HA membrane electro-spun from 2.5% (w/v) HA solution at an air blow rate of 70 $ft^3$/hr (Scale shown is 2 μm); (a) 39° C., (b) 47° C., and (c) 57° C.
Figure 6B:
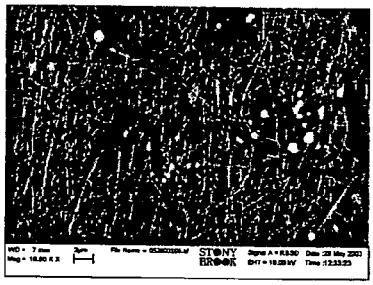
Figure 6C:
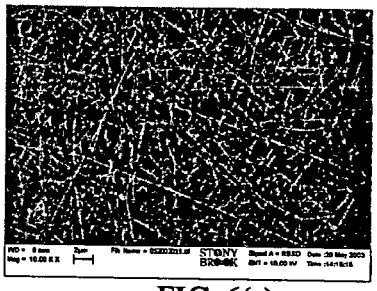

As presented in FIG. 6, as the temperature of air blow was raised, the electro-blowing process improved with increasing air temperature. The jet became stabilized as the temperature was increased to 57° C., resulting in the production of fine nanofibers.

Figure 7:
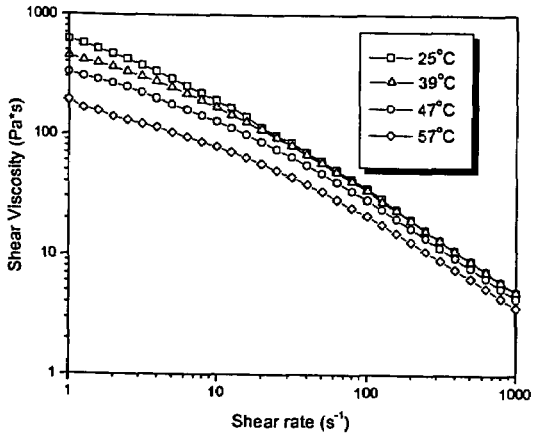
FIG. 7 is a graphical representation showing the effect of temperature on the viscosity of 2.5% HA solution.

In general, the requirement for high concentrations was circumvented by controlled and faster evaporation rates of the solvent. As shown in FIG. 7, the solution viscosity was decreased by a factor of 3 (618 to 192 Pa·s at 1 $s^{-1}$) when the temperature was raised from 25 to 57° C., allowing the electric force to pull the droplet at the spinneret into a jet stream. Furthermore, the water vapor pressure was increased from 3.17 kPa (25° C.) to 17.32 kPa (57° C.), resulting in a faster evaporation rate of the solvent and the fiber formation. Therefore, it can be said that the new electro-blowing process has provided additional means to change the solution viscosity and the solvent evaporation rate.

Figure 8:
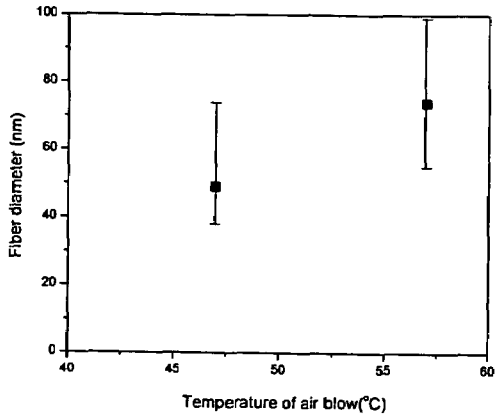
FIG. 8 is a graphical representation showing the effect of air blow temperature on the fiber diameter of HA nanofibers electrospun from 2.5% HA solution at a blow rate of 70 $ft^3$/hr.
Figure 9A:
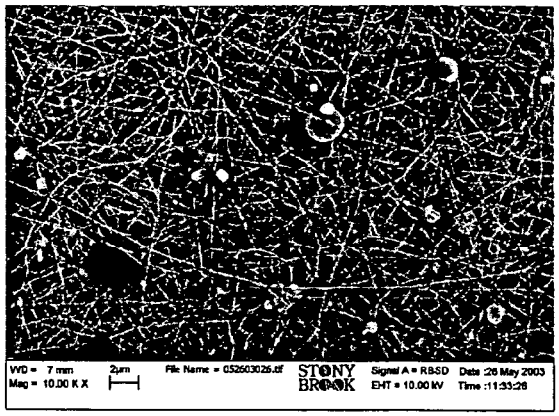
FIGS. 9(*a*)-(*d*) are photographs of electroblown fibers showing the effect of air blowing rate (around 57° C.) on the morphology of HA nanofibers electro-blown from 2% HA solution (Scale=2 μm). (a) 35 $ft^3$/hr (61° C.), (b) 70 $ft^3$/hr (57° C.), (c) 100 $ft^3$/hr (55° C.), and (d) 150 $ft^3$/hr (56° C.).
Figure 9B:
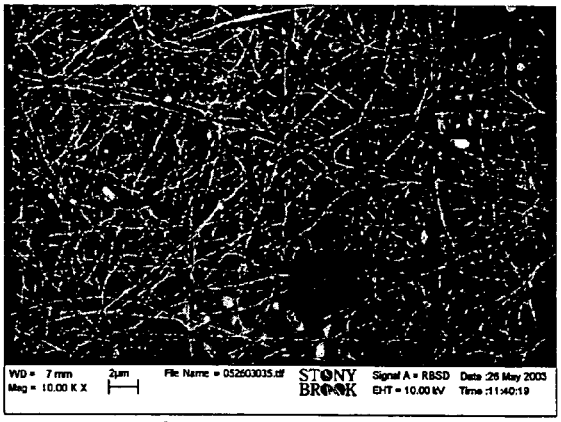
Figure 9C:
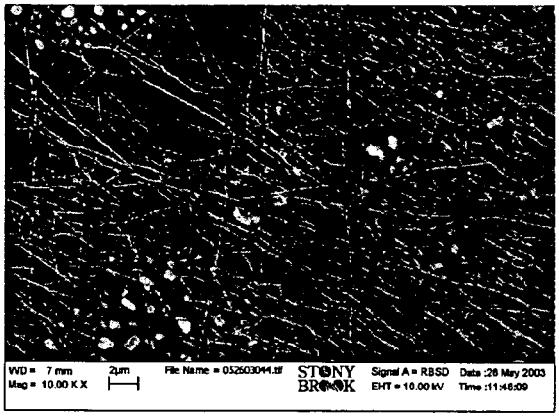
Figure 9D:
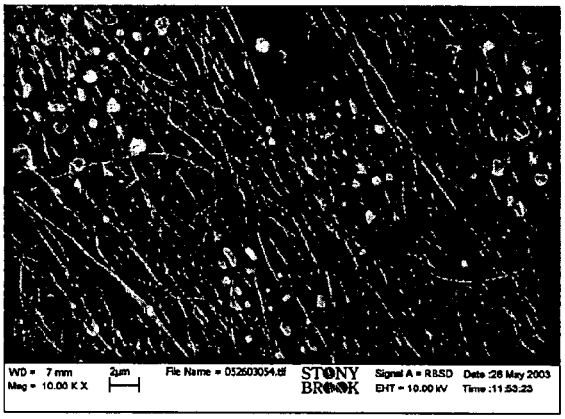
Figure 10A:
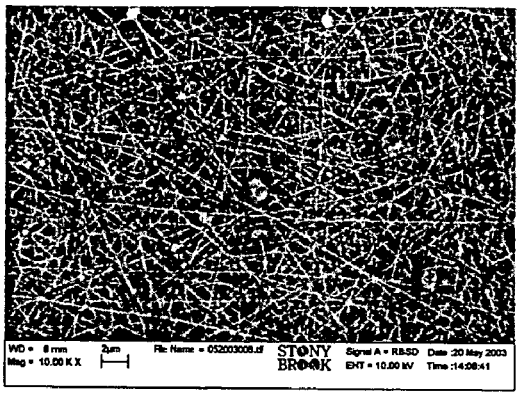
FIGS. 10(*a*)-(*d*) are photographs of electroblown fibers showing the effect of blow rate of air (around 57° C.) on the morphology of HA nanofibers electro-blown from 2.5% HA solution; (a) 35 $ft^3$/hr (61° C.), (b) 70 $ft^3$/hr (57° C.), (c) 100 $ft^3$/hr (55° C.), and (d) 150 $ft^3$/hr (56° C.).
Figure 10B:
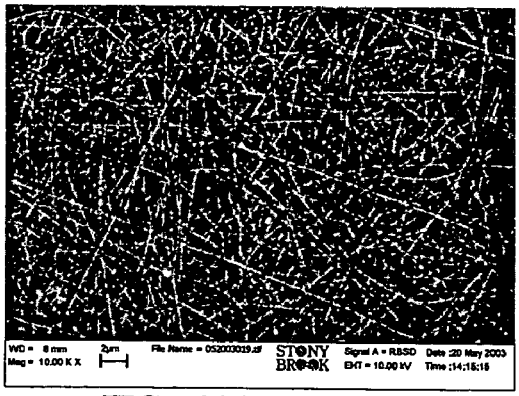
Figure 10C:
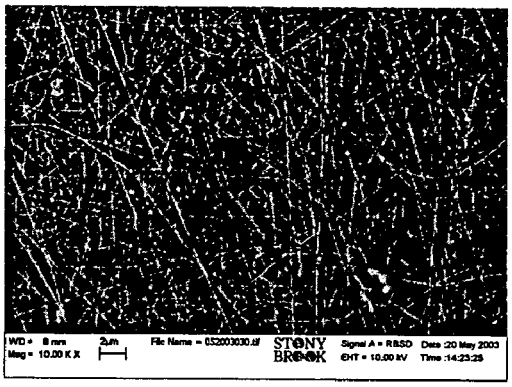
Figure 10D:
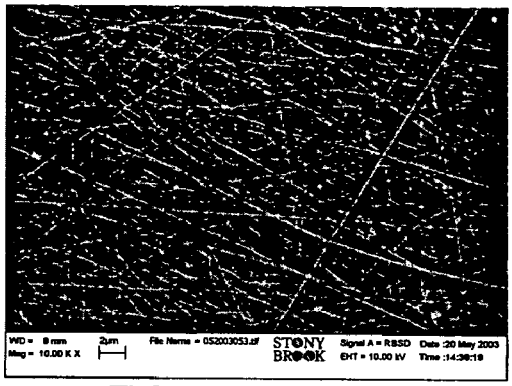

To examine the effect of air blow temperature on fiber size of electrospun HA nanofibers, the diameter was determined by averaging the diameter of 50 different fibers. At 37° C., the fiber diameters were irregular. However, as the temperature of air was increased, the average fiber diameter became increased (see FIG. 8). The increase in the fiber diameter at higher temperatures might be due to the higher drying rate of the solution. In general, the drying rate increased with temperature rise, making the polymer solution concentration change faster and resulting in an increase in the fiber diameter.

Effect of Air Blow Rate

In addition to the air blow temperature, the blow rate is another factor influencing the electro-blowing process, since it is intimately related to the viscosity and the drying rate. Therefore, different concentrated HA solutions (2, 2.5, and 3%) were electro-blown under different air flow rates to investigate their effects on the HA membrane formation. The SEM results are illustrated in FIGS. 9, 10 and 12.

Regardless of the concentrations tested, as the air-blowing rate was increased up to 70 $ft^3$/hr, the electro-blowing process was improved. On further increase of the air-blow rate, the process deteriorated, indicating the existence of an optimal condition for successful electro-blowing operation, provided that all the other variables remained constant. In general, the air blow rate has a positive and a negative role in the electro-blowing process: a fast evaporation and a viscosity rise. In the present case, the effect of increasing the drying rate is predominant until 70 $ft^3$/hr. However, after 70 $ft^3$/hr, the viscosity rise by fast drying could overwhelm the other desirable effects, resulting in a decrease in membrane quality.

Compared to the effect of temperature of air blow which has two positive roles, an increase of the evaporation rate and a decrease in the solution viscosity, the effect of air blow rate is less important in improving the electro-blowing process since it has a positive and a negative role at the same time.

Figure 11:
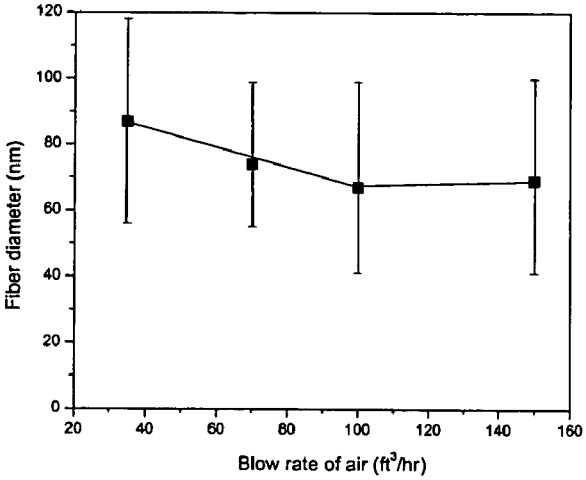
FIG. 11 is a graphical representation showing the effect of blow rate of air on the diameter of HA nanofibers electroblown from 2.5% HA solution.
Figure 12A:
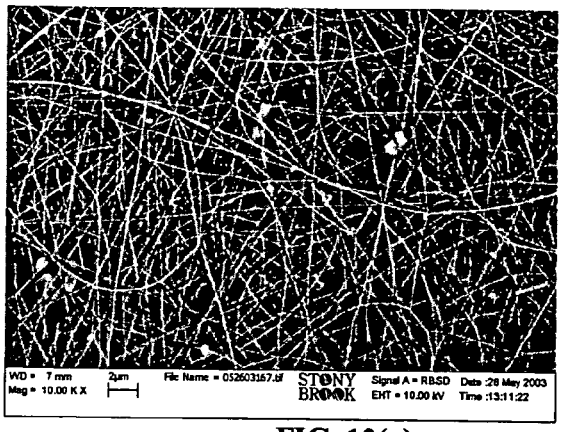
FIGS. 12(*a*)-(*d*) are photographs of electroblown fibers showing the effect of blow rate of air (around 57° C.) on the morphology of HA nanofibers electro-blown from 3% HA solution; (a) 35 $ft^3$/hr (61° C.), (b) 70 $ft^3$/hr (57° C.), (c) 100 $ft^3$/hr (55° C.), and (d) 150 $ft^3$/hr (56° C.).
Figure 12B:
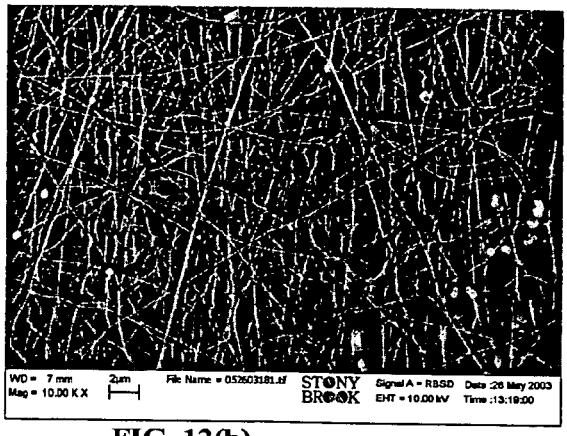
Figure 12C:
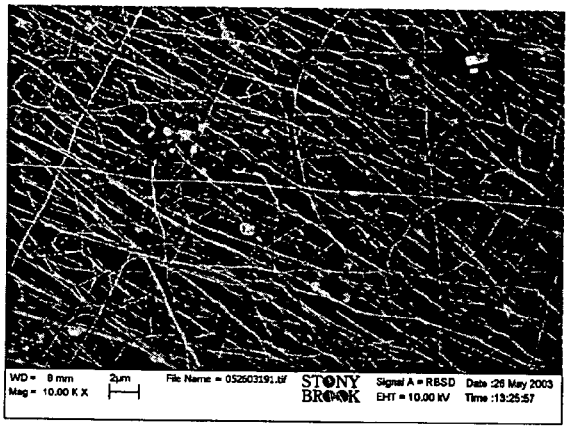
Figure 12D:
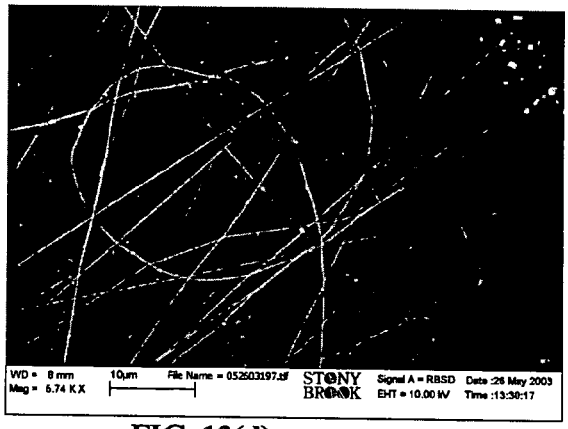
Figure 13A:
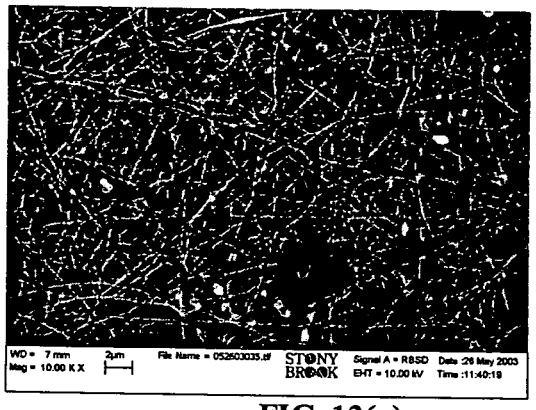
FIGS. 13(*a*)-(*e*) are photographs of electroblown fibers showing the effect of HA concentration on the morphology of HA nanofibers electro-blown by flowing hot air (57° C.) with 70 $ft^3$/hr of flow rate; (a) 2%, (b) 2.3%, (c) 2.5%, (d) 2.7%, and (e) 3%.
Figure 13B:
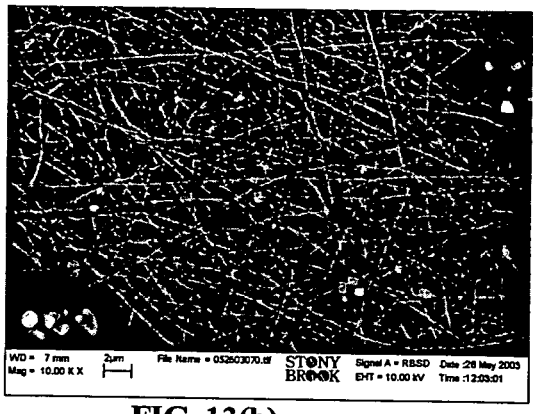
Figure 13C:
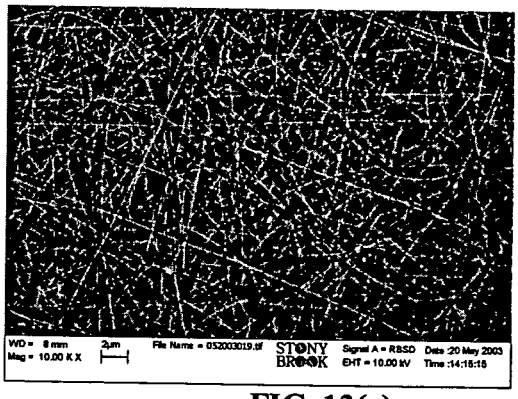
Figure 13D:
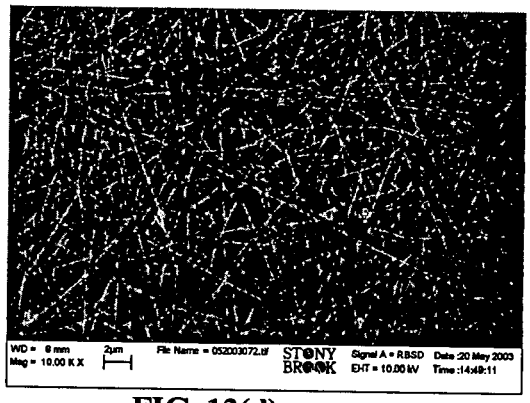
Figure 13E:
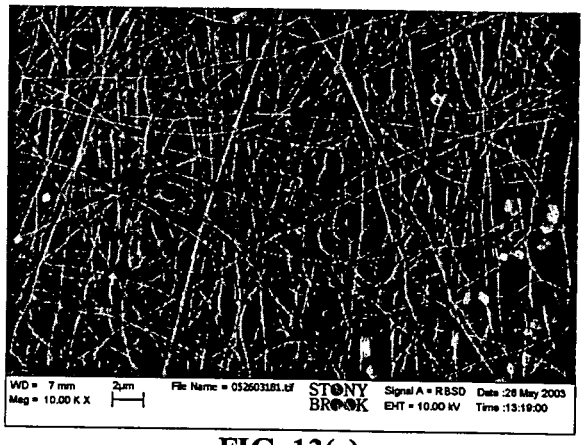

To elucidate the effect of air blowing rate on the diameter of electro-blown HA nanofibers, the fiber diameter for HA nanofibers electro-blown from a 2.5% HA solution, which is the current optimum concentration for electro-blowing, was measured and presented in FIG. 11. With the air-blowing rate increasing up to 100 $ft^3$/hr, the fiber diameter decreased. After that, no further change of the fiber diameter was observed, within the limited range of our current air flowing rate.

An increase in the air flowing rate can lead to an increase in the solvent evaporation rate and consequently enhance the HA polymer chain stretching during the electro-blowing spinning process, because the HA solution concentration could not be prepared at high enough concentrations due to its very high solution viscosity. With the solvent being evaporated, the entangled polymer chains at high enough concentrations could be stretched during its transit from the spinneret to the ground. However, at a rapid evaporation rate of the solvent and with the solution concentration becoming even higher, the stretching phase should be over very soon and the polymer chains could no longer be drawn further, i.e., corresponding to a reduction in the spin draw ratio, resulting in an increase in the fiber diameter. Thus, the air flowing rate and the air temperature can play multiple roles in controlling the fiber formation. Accordingly, the control of membrane quality can be tuned by using these additional parameters coming from the blowing process. It is assumed that the elongation effect is predominant until about 100 $ft^3$/hr.

Effect of HA Concentration

Various concentrations of HA solutions in acidic condition were prepared and electro-blown by flowing 57° C. hot air at 70 $ft^3$/hr of air flow rate. The optimum conditions for electro-spinning of HA were carried over. The results were used to elucidate the effects of HA concentration on the morphology of electro-blown HA membrane.

In FIG. 13, the HA solution showed a very good spinning condition at the concentration range from 2.5 to 2.7%(w/v) indicating an optimal solvent content and a solution viscosity for the electro-blowing of HA.

Similar to conventional electro-spinning at high solution viscosity, the electric force may not overcome the viscosity/surface tension of the fluid, resulting in the failure to produce a stable jet stream. On the other hand, at low solution viscosity, the polymer chains are not sufficiently entangled. Thus, the combination of blowing and electrical force increases the boundary conditions acceptable for polymer solutions within a viscosity, surface tension, concentration, and molecular weight range. The electro-blowing of HA represents a demonstration of this new technique in which both the pulling force of the gaseous flow and that of the applied electric field are utilized.

Figure 14:
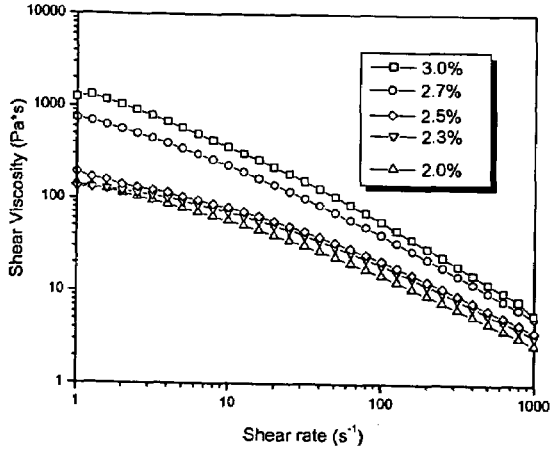
FIG. 14 is a graphical representation showing the viscosity of HA solutions at various concentrations at 57° C.
Figure 16:
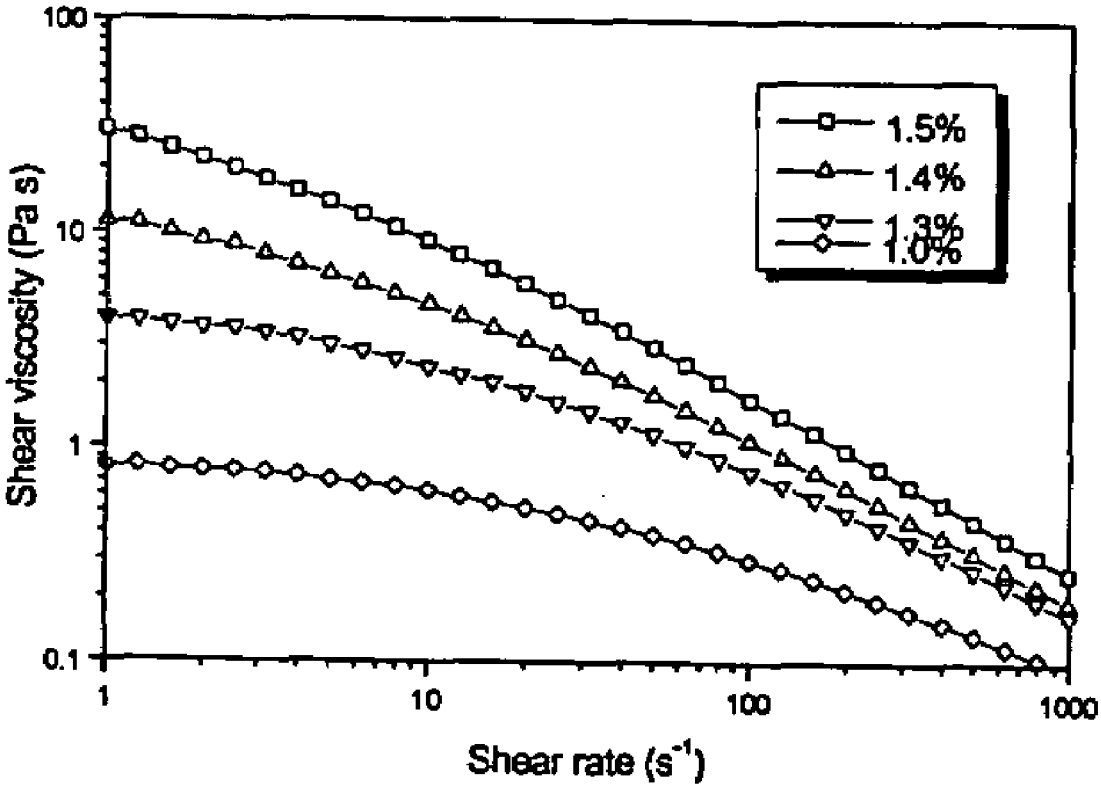
FIG. 16 is a graphical representation showing the viscosity of acidic HA-C solution (pH 1.5) at different concentrations.
Figure 17A:
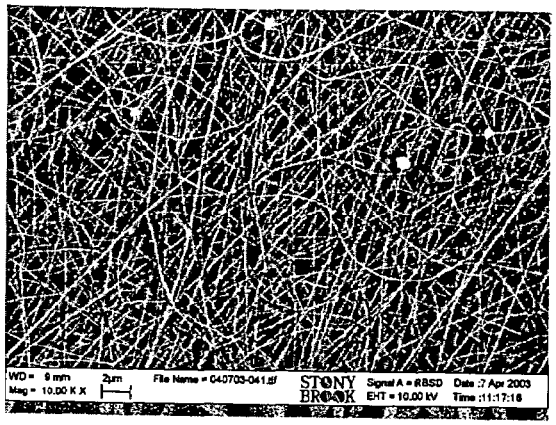
FIGS. 17(*a*)-(*d*) are photographs of electroblown fibers showing the effect of solution feeding rate on the morphology of electro-blown HA fibers (2.5%) prepared by blowing air (61° C.) with 35 $ft^3$/hr of blow rate; (a) 30 μl/min, (b) 40 μl/min, (c) 50 μl/min, and (d) 60 μl/min.
Figure 17B:
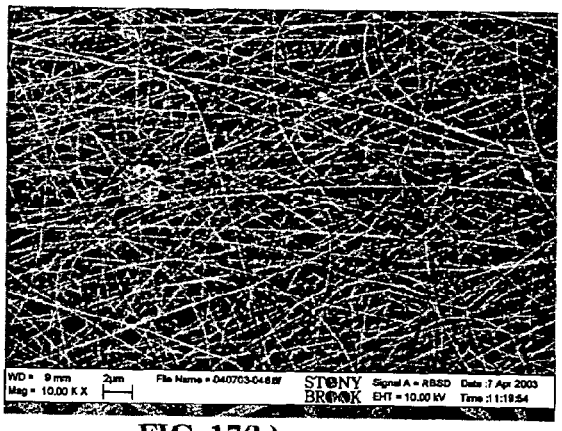
Figure 17C:
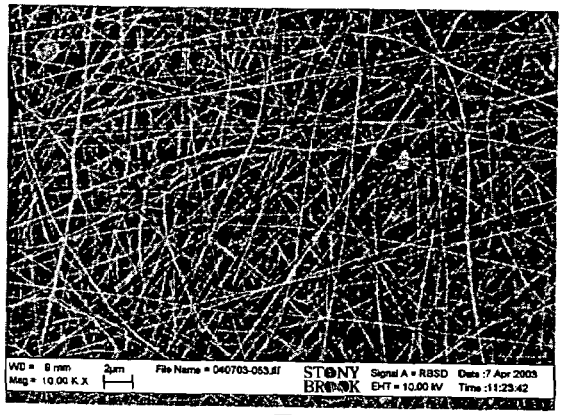
Figure 17D:
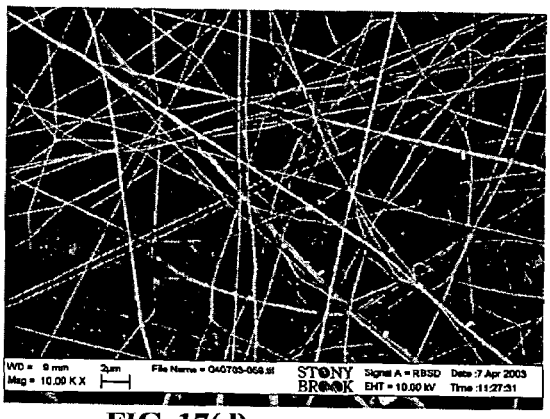

The optimum concentration range (2.5-2.7%) for electro-spinning of HA has a viscosity range from 100 to 1000 Pa·s, as shown in FIG. 14. As noted above, the viscosity range of HA-C solution for just fiber formation is 30-300 Pa·s (FIG. 16). In addition, it was also found that the viscosity range of HA-5 solution with added DMF should be 2-20 Pa·s for nanofiber production. Therefore, the fact that the present method could successfully electro-blow HA solution with 100-1000 Pa·s indicates the importance of combining gaseous flow with electrical force. It should be noted that this represents only a demonstration of a preferred embodiment of the present invention, showing the potential in this new technique. In melt blowing, very high-speed gaseous flow has been used. In the present approach, we strive for a balance between the two pulling forces, depending on the fluid properties. Furthermore, control of the gaseous temperature has been introduced as an additional variable that can affect the electro-blowing process.

Figure 15:
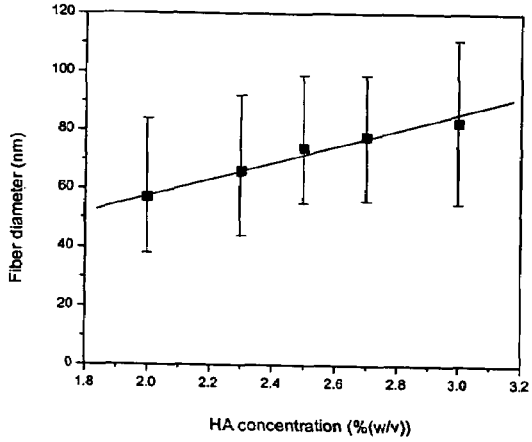
FIG. 15 is a graphical representation showing the effect of HA concentration on fiber diameter of HA nanofibers electroblown by flowing hot air (57° C.) with 70 $ft^3$/hr of flow rate.

The fiber diameter of electrospun HA fiber was increased from 57 to 83 nm with the concentration rise (see FIG. 15). In general, a smaller amount of the solvent at higher concentrations can be removed over a fixed time period. Thus, the faster evaporation rate could reduce the spin-draw ratio during electro-blowing, resulting in a larger fiber diameter.

Effect of Feeding Rate of Solution

The feeding rate of solution during electro-blowing is another factor affecting the fabrication process, including the efficiency of production. 2.5% HA solution was electro-blown by using different fluid feeding and gaseous blowing rates in order to elucidate their effects on the process.

Under less favorable conditions for the electro-spinning of HA, 61° C. of air blowing with 35 $ft^3$/hr of flow rate, the HA solution showed relatively good fiber formation until 50 μl/min of feeding rate (FIG. 17). However, above that, the jet became extremely unstable resulting in dripping of droplets from the spinneret during electro-blowing.

Figure 18A:
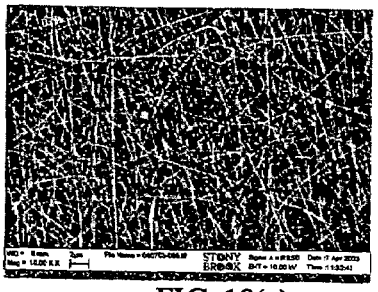
FIGS. 18(*a*)-(*c*) are photographs of electroblown fibers showing the effect of solution feeding rate on the morphology of electro-blown HA fibers (2.5%) prepared by blowing hot air (57° C.) with 70 $ft^3$/hr of blow rate (scale=2); (a) 20 μl/min, (b) 40 μl/min, and (d) 60 μl/min.
Figure 18B:
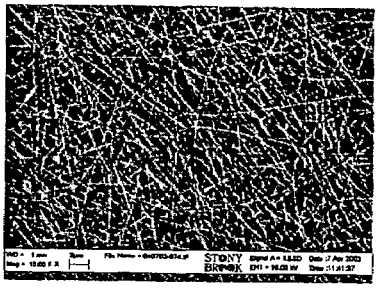
Figure 18C:
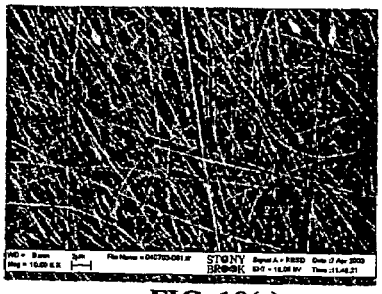
Figure 19A:
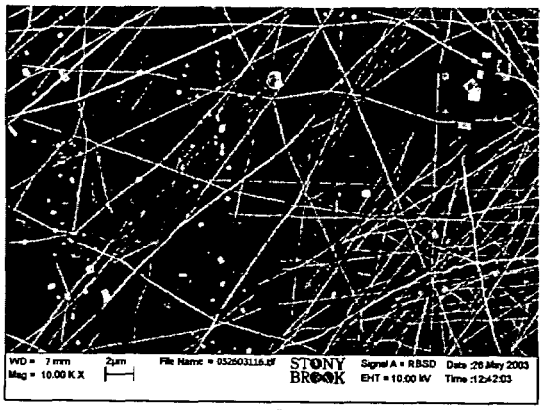
FIGS. 19(*a*)-(*e*) are photographs of electroblown fibers showing the effect of electric field strength on the electroblown process of 2.5% HA solution with airflow conditions of hot air at 57° C. with 70 $ft^3$/hr of flow rate, at an electric potential=(a) 24 kV, (b) 25 kV, (c) 30 kV, (d) 35 kV, and (e) 40 kV.
Figure 19B:
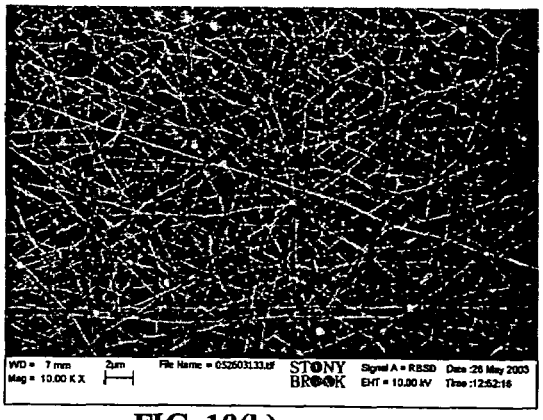
Figure 19C:
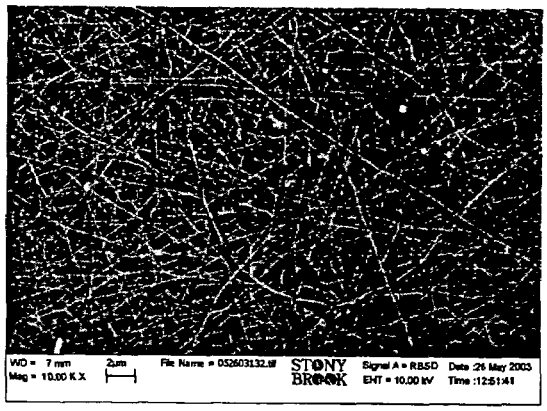
Figure 19D:
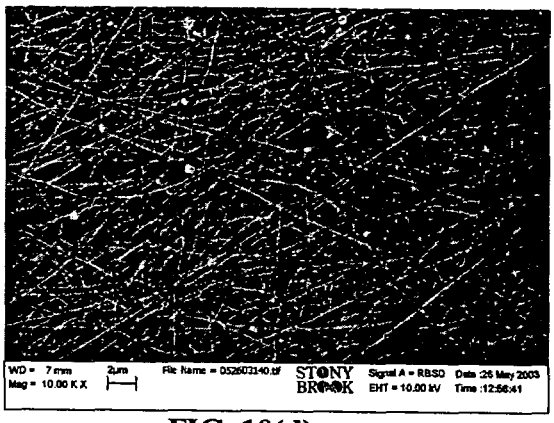
Figure 19E:
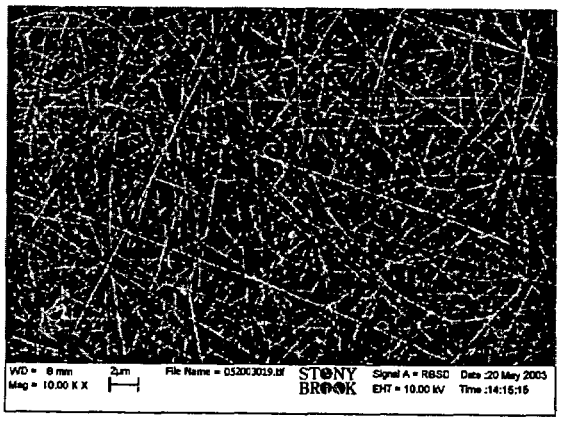

By using more favorable conditions for the electro-spinning of HA and with 57° C. of air blowing at 70 $ft^3$/hr of flow rate (see FIG. 18), the results show better morphology until about 60 μl/min when an unstable jet was developed abruptly. Based on the preliminary tests with limited variations, it is reasonable to set 40 μl/min of feeding rate as a preferred embodiment, whereby both the jet stability and the efficiency of production are taken into account.

Effect of Electric Field

The applied electric field is one of the important factors influencing the electro-blowing process. For the electro-spinning of HA, high voltage was employed in order to produce sufficient force to pull the droplet at the spinneret into a jet stream. However, with the air blow system, the applied electric field strength can preferably be reduced.

A 2.5% HA solution was electro-blown under various applied electric field strengths to investigate the effects of applied electric field. In FIG. 19, the electric force could not overcome the solution resistance to form a jet stream until the applied electric potential reached 24 kV. The jet became stabilized at 25 kV and remained stabilized until 40 kV.

Figure 20:
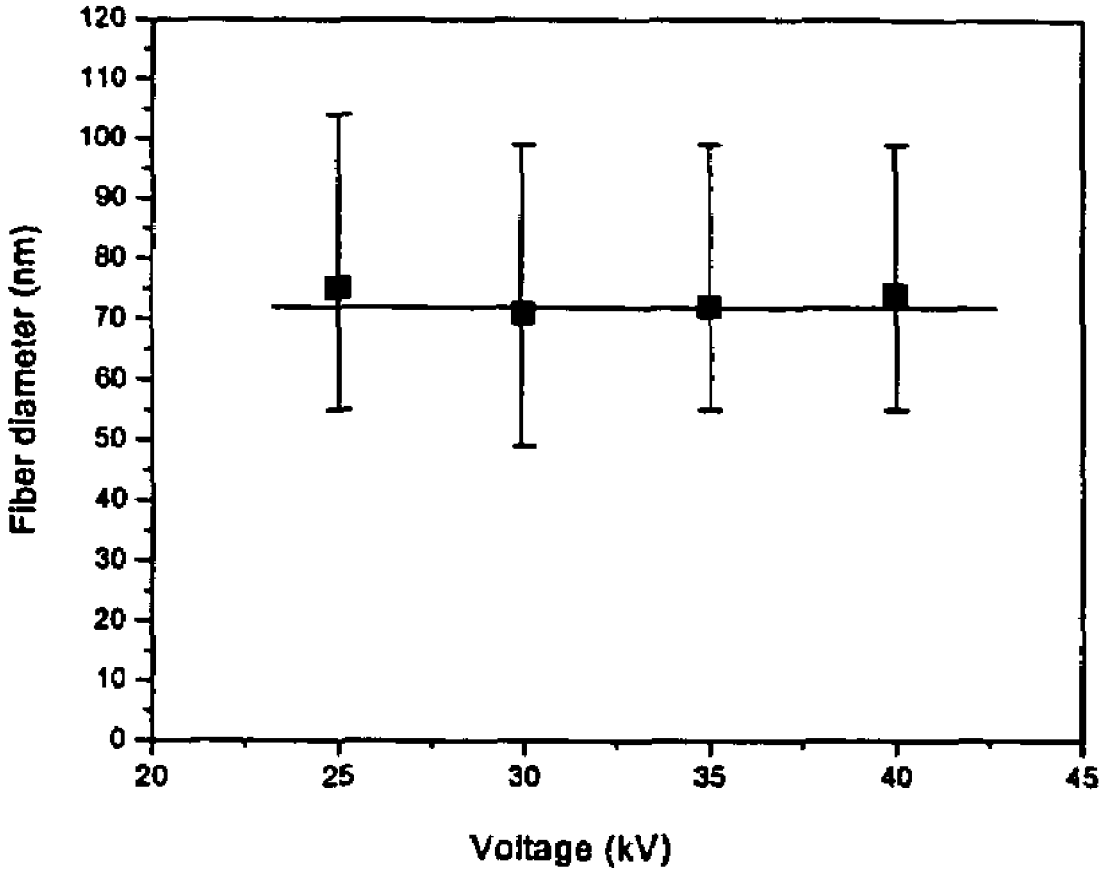
FIG. 20 is a graphical representation showing the effect of electric field on the average fiber diameter of HA nanofiber electro-blown from 2.5% solution at a temperature and blow rate of air of 57° C. and 70 $ft^3$/hr, respectively.

The measurement of fiber diameter (FIG. 20) showed that the electric field strength did not influence the fiber diameter of electro-blown HA fibers significantly.

Obviously, additional modifications and variations of the present invention are possible in light of the above teachings. It is therefore to be understood that within the scope of the appended claims, the invention may be practiced otherwise than as specifically described herein.

REFERENCES CITED ABOVE

1. Zeleny, J., Phys. Rev. 1914. 3: p. 69-91.
2. Formhals, A., "Process and Apparatus for Preparing Artificial Threads", 1934: U.S. Pat. No. 1,975,504.
3. Taylor, G. I., Proc. Roy. Soc. Lond. A. 1969.31: p. 453-475.
4. Deitzel, J. M.; Kosik, W.; McKnight, S. H.; Beck Tan, N. C.; DeSimone, J. M.; Crette, S., "Electrospinning of polymer nanofibers with specific surface chemistry", Polymer 2001, 43(3): p. 1025-1029.
5. Koombhongse, Sureeporn; Liu, Wenxia; Reneker, Darrell H., "Flat polymer ribbons and other shapes by electrospinning", J. Polym. Sci., Part B: Polym. Phys., 2001, 39(21): p. 2598-2606.
6. Shin, Y. M.; Hohman, M. M.; Brenner, M. P.; Rutledge, G. C., "Experimental characterization of electrospinning: the electrically forced jet and instabilities", Polymer, 2001, 42(25): p. 09955-09967.
7. Bognitzki, Mikhail; Frese, Thomas; Steinhart, Martin; Greiner, Andreas; Wendorff, Joachim H.; Schaper, Andreas; Hellwig, Michael. "Preparation of fibers with nanoscaled morphologies: electrospinning of polymer blends", Polym. Eng. Sci., 2001, 41(6): p. 982-989.
8. Stitzel, Joel D.; Bowlin, Gary L.; Mansfield, Kevin; Wnek, Gary E.; Simpson, David G., "Electrospraying and electrospinning of polymers for biomedical applications. Poly (lactic-co-glycolic acid) and poly(ethylene-co-vinylacetate)", International SAMPE Technical Conference, 2000, 32: p. 205-211
9. Shin, Y. M.; Hohman, M. M.; Brenner, M. P.; Rutledge, G. C., "Electrospinning: A whipping fluid jet generates submicron polymer fibers", Appl. Phys. Lett., 2001, 78(8): p. 1149-1151.
10. Bognitzki, Michael; Hou, Haoqing; Ishaque, Michael; Frese, Thomas; Hellwig, Michael; Schwarte, Christoph; Schaper, Andreas; Wendorff, Joachim H.; Greiner, Andreas, "Polymer, metal, and hybrid nano- and mesotubes by coating degradable polymer template fibers (TUFT process)", Adv. Mater. (Weinheim, Ger.), 2000, 12(9): p. 637-640.
11. Spivak, A. F.; Dzenis, Y. A., "A condition of the existence of a conductive liquid meniscus in an external electric field", J. Appl. Mech., 1999, 66(4): p. 026-1028.
12. Fong, H.; Chun, I.; Reneker, D. H., "Beaded nanofibers formed during electrospinning", Polymer, 1999, 40(16): p. 4585-4592.
13. Reneker, Darrell H.; Chun, Iksoo., "Nanometer diameter fibers of polymer, produced by electrospinning", Nanotechnology, 1996, 7(3): p. 216-223.

14. Gibson, P., Schreuder-Gibson, H., and Pentheny, C., "Electrospinning Technology: Direct Application of Tailorable Ultrathin Membranes", J. Coated Fabrics, 1998. 28: p. 63-72.
15. Fang, X., and Reneker, D. H., "DNA Fibers by Electrospinning", J. Macromol. Sci. Phys., 1997. B36(2): p. 169-173.
16. Doshi, J., and Reneker, D. H., "Electrospinning Process and Applications of Electrospun Fibers", J. Electrostatics, 1995. 35: p. 151-160.
17. Baumgarten, P. K., "Electrostatic Spinning of Acrylic Microfibers", J. Colloid Interface Sci., 1971. 36: p. 71-79.
18. Larrondo, L., and St. John Manley, R., "Electrostatic Fiber Spinning from Polymer Melts. I. Experimental Observations on Fiber Formation and Properties", J. Polym. Sci.: Polym. Phys. Ed., 1981. 19: p. 909-920
19. Larrondo, L., and St. John Manley, R., "Electrostatic Fiber Spinning from Polymer Melts. II. Examination of the Flow Field in an Electrically Driven Jet", J. Polym. Sci.: Polym. Phys. Ed., 1981. 19: p. 921-932
20. Larrondo, L., and St. John Manley, R., "Electrostatic Fiber Spinning from Polymer Melts. III. Electrostatic Deformation of a Pendant Drop of Polymer Melt", J. Polym. Sci.: Polym. Phys. Ed., 1981. 19: p. 933-940.
21. Jaeger, R., Bergshoef, M. M., Martin, C., Schonherr, H.; and Vancso, G. J., Macromol. Symp., 1998. 127: p. 141-150.
22. Zachariades, A. E., Porter, R. S., Doshi, J., Srinivasan, G., and Reneker, D. H., "High Modulus Polymers: A Novel Electrospinning Process", Polym. News, 1995. 20: p. 206-207.
23. Gibson, P., Schreuder-Gibson, H., Pentheny, C., "Electrospinning technology: direct application of tailorable ultrathin membranes", J. Coated Fabrics, vol. 28, pp. 63, July (1998).
24. Schreuder-Gibson, H. L., Gibson, P., Hsieh, Y.-L. "Process-properties study of melt blowing polyurethane for elastic military protective apparel garments", International Nonwovens Technical Conference, Baltimore, 244 (2001).
25. Krishnappa, Ravi V. N.; Sung, Changmo; Schreuder-Gibson, Heidi., Materials Research Society Symposium Proceedings, 702 (Advanced Fibers, Plastics, Laminates and Composites), 235 (2002).
26. Gibson, P. W.; Schreuder-Gibson, H. L.; Rivin, D. "Electrospun fiber mats: transport properties", AIChE Journal, 45(1), 190 (1999).
27. B. Chu, B. S. Hsiao and D. Fang, "Apparatus and Methods for Electrospinning Polymeric Fibers and Membranes." PCT Int. Appl. (2002), 55 pp. WO 0292888.
28. B. Chu, B. S. Hsiao, D. Fang and C. Brathwaite, "Biodegradable and/or Bioabsorbable Fibrous Articles and Methods for Using the Articles for Medical Applications. U.S. Pat. Appl. Publ. (2002), 29 pp. US 2002173213.
29. B. Chu, B. S. Hsiao, M. Hadjiargyrou, D. Fang, S. Zong and K. S. Kim "Cell Storage and Delivery System", U.S. Pat. Appl. Publ. (2003), US 20030054035.
30. Xinhua Zong, Dufei Fang, Kwang-Sok Kim, Jeyoung Kim, Sharon Cruz, Benjamin S. Hsiao and Benjamin Chu, "Structure and Process Relationships in Bioabsorbable Nanofiber Membranes by Electrospinning", Polymer, 43(16), 4403-4412 (2002).
31. Y. K. Luu, K. Kim, B. S. Hsiao, B. Chu, M. Hadjiargyrou, "Development of a Nanostructured DNA Delivery Scaffold via Electrospinning of PLGA and Block Copolymers", J. Control Release, 89, 341-353 (2003).
32. Xinhua Zong, Kwangsok Kim, Shaofeng Ran, Dufei Fang, Benjamin S. Hsiao and Benjamin Chu, "Structure and Morphology Changes during In Vitro Degradation in Electrospun Poly(glycolide-co-lactide) Bioabsorbable Nanofiber Membranes", Biomacromolecules, 4(2), 416-423 (2003).
33. Xinhua Zong, Shaofeng Ran, Benjamin S. Hsiao and Benjamin Chu, "Control of Structure/Morphology and Property of Poly(glycolide-co-lactide) Nanofiber Membranes via Electrospinning and Post-treatments", Polymer, in press (2003).
34. Kwangsok Kim, Meiki Yu, Steven X. Zong, Jonathan Chiu, Dufei Fang, Young Soo Seo, Benjamin S. Hsiao, Benjamin Chu and Michael Hadjiargyrou, "Control of Degradation Rate and Hydrophilicity in Electrospun Poly (DL-lactide) Membranes for Cell Scaffolding", Biomaterials, in press (2003).

The invention claimed is:

1. A method for electroblowing nanofibers comprising:

forcing a polymer fluid through a spinneret in a first direction towards a collector located a first distance from said spinneret, to form submicron diameter nanofibers, while simultaneously blowing a gas through an orifice that is substantially concentrically arranged around said spinneret, wherein said gas is blown substantially in said first direction to contact the nanofibers;

wherein an electrostatic differential is generated between said spinneret and said collector; and collecting the nanofibers;

wherein said polymer fluid comprises a member selected from the group consisting of hyaluronan, copolymers of hyaluronan and mixtures thereof.

2. The method of claim 1, wherein said collecting is performed by applying shear and elongational forces on the polymer fluid between said spinneret and said collector to further stretch the polymer fluid and deposit the submicron sized nanofibers on the collector.

3. The method of claim 1, wherein said polymer fluid is a polymer melt.

4. The method of claim 1, wherein said polymer fluid is a polymer-containing solution comprising a polymer and a solvent.

5. The method of claim 4, wherein said polymer-containing solution comprises a mixture of two or more polymers and one or more solvents.

6. The method of claim 1, wherein said polymer fluid comprises a polymer suspension comprising a polymer and a solvent, optionally comprising suspended particles.

7. The method of claim 6, wherein said polymer suspension comprises a mixture of two or more polymers and one or more solvents, optionally comprising suspended particles.

8. The method of claim 1, wherein said electrostatic differential is generated by applying an electrostatic potential between said spinneret and said collector.

9. The method of claim 1, wherein said electrostatic differential is generated by applying an electrostatic potential to a secondary electrode and said collector.

10. The method of claim 1, wherein said gas is a member selected from air, nitrogen, reactive gases, inert gases and mixtures thereof.

11. The method of claim 10, wherein said gas is air.

12. The method of claim 1, wherein said gas is heated.

13. The method of claim 1, wherein said gas is cooled.

14. The method of claim 13, wherein said gas is cooled to a temperature in a range from −50° C. to 350° C.

15. The method of claim 1, wherein said polymer fluid is a hyaluronan-containing solution comprising a solvent and from 0.01 to 8 wt % of a member selected from the group consisting of hyaluronan, copolymers of hyaluronan and mixtures thereof.

16. The method of claim 15, wherein said solvent comprises a member selected from the group consisting of water, minimal essential medium (Earle's salts), chloroform, methylene chloride, acetone, 1,1,2-trichloroethane, dimethylformamide (DMF), tetrahydrofuran (THF), methanol, ethanol, 2-propanol, dimethylacetamide (DMAc), N-methylpyrrolidone, acetic acid, formic acid, hexafluoro-2-propanol (HFIP), hexafluoroacetone, 1-methyl-2-pyrrolidone, glycerol, low molecular weight poly(ethylene glycol), low molecular weight paraffins, low molecular weight fluorine-containing hydrocarbons, low molecular weight fluorocarbons, and mixtures thereof.

17. The method of claim 1, wherein said electrostatic differential is from 1 to 100 kV.

18. The method of claim 17, wherein said electrostatic differential is from 15 to 50 kV.

19. The method of claim 18, wherein said electrostatic differential is from 30 to 45 kV.

20. The method of claim 1, wherein said gas is blown at a rate of up to the velocity of sound.

21. The method of claim 20, wherein said gas is blown at a rate of up to 300 SCFH.

22. The method of claim 21, wherein said gas is blown at a rate of from 10 to 250 SCFH.

23. The method of claim 22, wherein said gas is blown at a rate of from 30 to 150 SCFH.

24. The method of claim 12, wherein said gas is heated to a temperature of up to 350° C.

25. The method of claim 24, wherein said gas is heated to a temperature of from 25 to 120° C.

26. The method of claim 25, wherein said gas is heated to a temperature of from 40 to 90° C.

27. The method of claim 13, wherein said gas is cooled to a temperature of down to −100° C.

28. The method of claim 27, wherein said gas is cooled to a temperature in the range of from −50 to 25° C.

29. The method of claim 28, wherein said gas is cooled to a temperature in the range of from −20 to 10° C.

30. The method of claim 1, wherein a charge density of said polymer fluid is increased by injection of electrostatic charges into said polymer fluid.

31. The method of claim 1, wherein said collector is maintained at a temperature in the range of from −20 to 80° C.

32. The method of claim 4, wherein said gas is blown at a rate and a temperature sufficient to cause substantial evaporation of said solvent prior to the nanofibers reaching said collector.

33. The method of claim 1, wherein said electrostatic differential is generated by application of an electrostatic potential in proximity to said collector and on a side of said collector opposite to said spinneret.

* * * * *